US005222791A

United States Patent [19]

Held et al.

[11] Patent Number: 5,222,791

[45] Date of Patent: Jun. 29, 1993

[54] SECURING APPARATUS FOR THE FRONT PANEL OF A DRAWER

[75] Inventors: Wolfgang Held, Hard; Maximilian Mai, Feldkirch-Tisis, both of Austria

[73] Assignee: Julius Blum Gesellschaft m.b.H., Hochst, Austria

[21] Appl. No.: 644,733

[22] Filed: Jan. 18, 1991

[30] Foreign Application Priority Data

Jan. 22, 1990 [AT] Austria ..... 124/90

[51] Int. Cl.[5] ..... A47B 95/00

[52] U.S. Cl. ..... 312/348.4

[58] Field of Search ..... 312/348.4, 348.1, 263

[56] References Cited

U.S. PATENT DOCUMENTS 4,846,538 7/1989 Rock et al. ..... 312/263
4,850,659 7/1989 Rock et al. ..... 312/263

FOREIGN PATENT DOCUMENTS 0291781 11/1988 European Pat. Off. ..... 312/348.4
3120555 6/1982 Fed. Rep. of Germany ... 312/348.4
3801816 8/1988 Fed. Rep. of Germany ... 312/348.4
1185585 3/1970 United Kingdom ..... 312/348.4

*Primary Examiner*—Kenneth J. Dorner
*Assistant Examiner*—Gerald A. Anderson
*Attorney, Agent, or Firm*—Wenderoth, Lind & Ponack

[57] ABSTRACT

An apparatus for securing a front panel of a drawer to a respective side wall of the drawer includes a housing having an interior and to be mounted to a front end of the drawer side wall. A carrier member is mounted in the interior of the housing and has a U-shaped configuration including a horizontal web and spaced side flanges extending vertically therefrom. A latch member is supported by the carrier member for height displacement relative thereto and has a U-shaped configuration including a vertical web having spaced side flanges extending horizontally rearwardly therefrom. A holding member to be mounted on the drawer front panel has a hook portion to engage with the web of the latch member when the front panel is to be mounted on the drawer. A spring acts on the latch member to urge it upwardly relative to the carrier member and therefore into engagement with the holding member. A bracing screw is threaded to the web of the carrier member and is mounted in the housing to be rotatable relative thereto but to be fixed axially. Rotation of the bracing screw pivots the carrier member and therefore the latch member about horizontal axis to thereby brace the engagement between the latch member and the holding member.

20 Claims, 9 Drawing Sheets

SECURING APPARATUS FOR THE FRONT PANEL OF A DRAWER

BACKGROUND OF THE INVENTION

The invention relates to a securing apparatus for the front panel of a drawer, there being securable to the front panel hook-type holding members which, when the front panel is mounted, are suspendable on carrier members associated with side walls of the drawer and which may be braced by the carrier members. Provided on each side of the drawer is a housing which may be secured by means of dowel or the like to a respective side wall of the drawer, made of wood material, for example chipboard. Each housing mounts a respective carrier member.

The invention furthermore relates to a removable holding apparatus for a pull-out rail secured to the drawer of a pull-out guide assembly, with the pull-out rail having at the rear a hook by means of which it is suspendable in the drawer and having at the front an open horizontal slit into which projects a laterally extending holding peg of the drawer or of the holding apparatus.

Various securing apparatuses for the front panel of a drawer are known, differing principally according to whether the drawer side walls are made of plastic material or of metal. With drawer frames of metal, the front panel is usually suspended by means of holding members directly in the drawer frames or is connected thereto. This means that the actual carrier member of the securing apparatus for the front panel is part of the drawer frame. However, if the drawer side walls are made of plastic, then the pull-out rails of the pull-out guide assemblies of the drawer are provided at their front ends with angular carrier members in which the holding members of the securing apparatus for the front panel are suspendable.

Front panels of wooden drawers, in accordance with the known prior art, are dowelled to the side walls of the drawer, which means that a subsequent adjustment of the front panel is not possible.

SUMMARY OF THE INVENTION

It is an object of the invention to provide a securing apparatus of the type mentioned above, and which is suitable in particular for anchoring a front panel and subsequent positioning of a front panel on a drawer having side walls of wood. In accordance with the invention, this is achieved in that the carrier member as seen from the front is constructed in a U-shape with lateral flanges receives a latch or insert member which is U-shaped in plan view, which is height-displaceable and which is acted upon by a spring. The carrier member may be tilted about a horizontal axis by means of a screw arranged perpendicularly in a housing and held in the housing to be rotatable but to axially fixed.

A further object of the invention is to provide a removable holding apparatus for a pull-out rail which is secured to the drawer and which may be mounted together with the securing apparatus for the front panel on the drawer side wall. The holding apparatus, like the clamping means of the securing apparatus for the front panel, may be actuated from above. This is achieved by a locking peg which is displaceable perpendicular to the pull-out rail and which preferably is acted on by a pressure spring to project into an opening in the pull-out rail. A vertically movable unlocking rod is held in an upper end position by a pressure spring may be moved downwardly to move the peg out of the rail, the unlocking rod bearing by means of a wedge surface or edge against a stop of the locking peg.

BRIEF DESCRIPTION OF THE DRAWINGS

Examplary embodiments of the invention will be described below with reference to the attached drawings, wherein.

DETAILED DESCRIPTION OF THE INVENTION

In conventional manner, a drawer comprises two drawer panel 1. The drawer side walls 2 are made of wood, a chipboard or the like. In addition to the front panel I, as can be seen from FIG. 2 the drawer also may be provided with a front plate, 7 which connects the two side walls 2 to one another via securing apparatuses 5 for securing the front panel 1.

Figure 1:
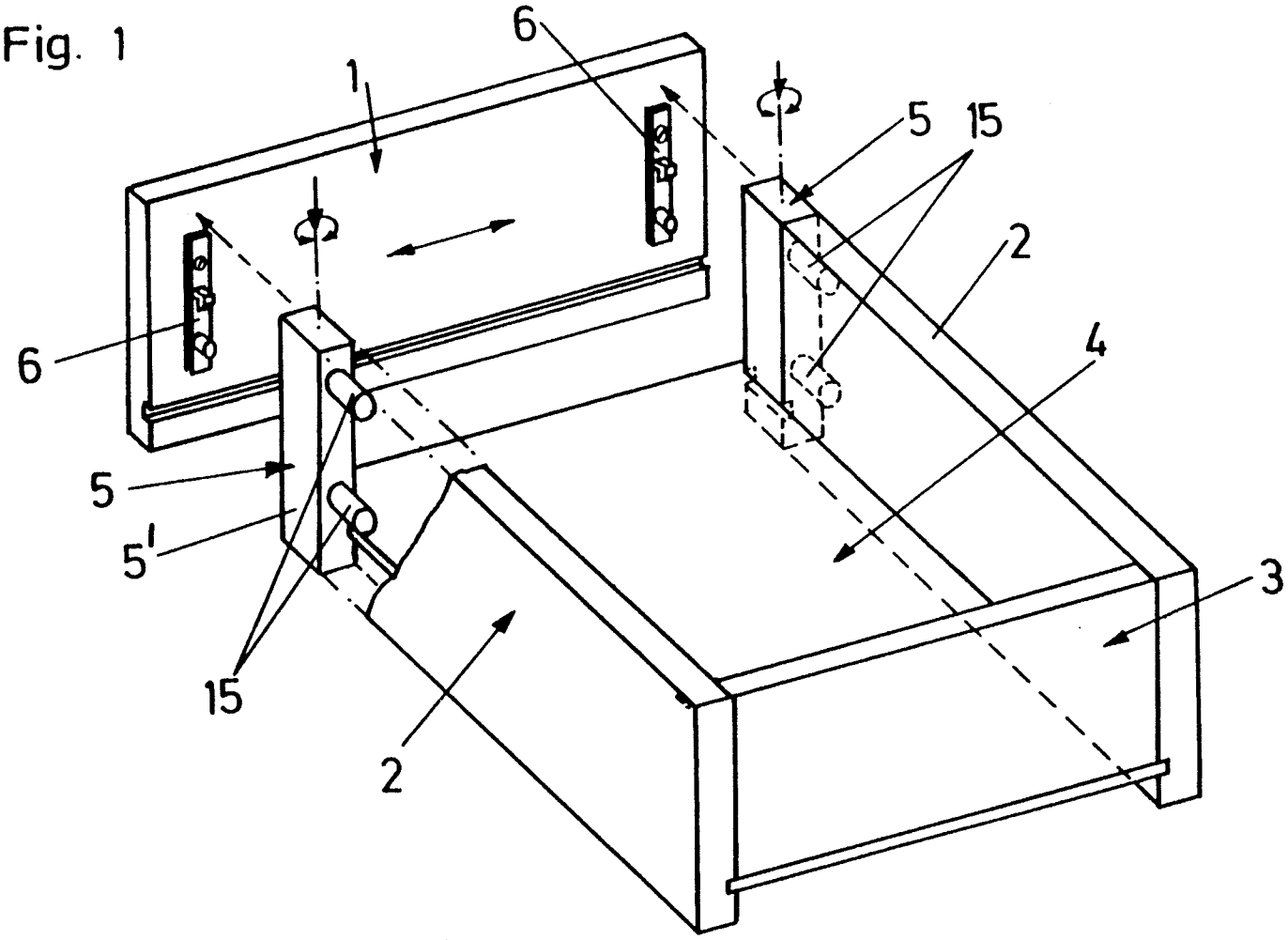
FIG. 1 and FIG. 2 each are perspective views showing drawers having a securing apparatus according to the invention.
Figure 2:
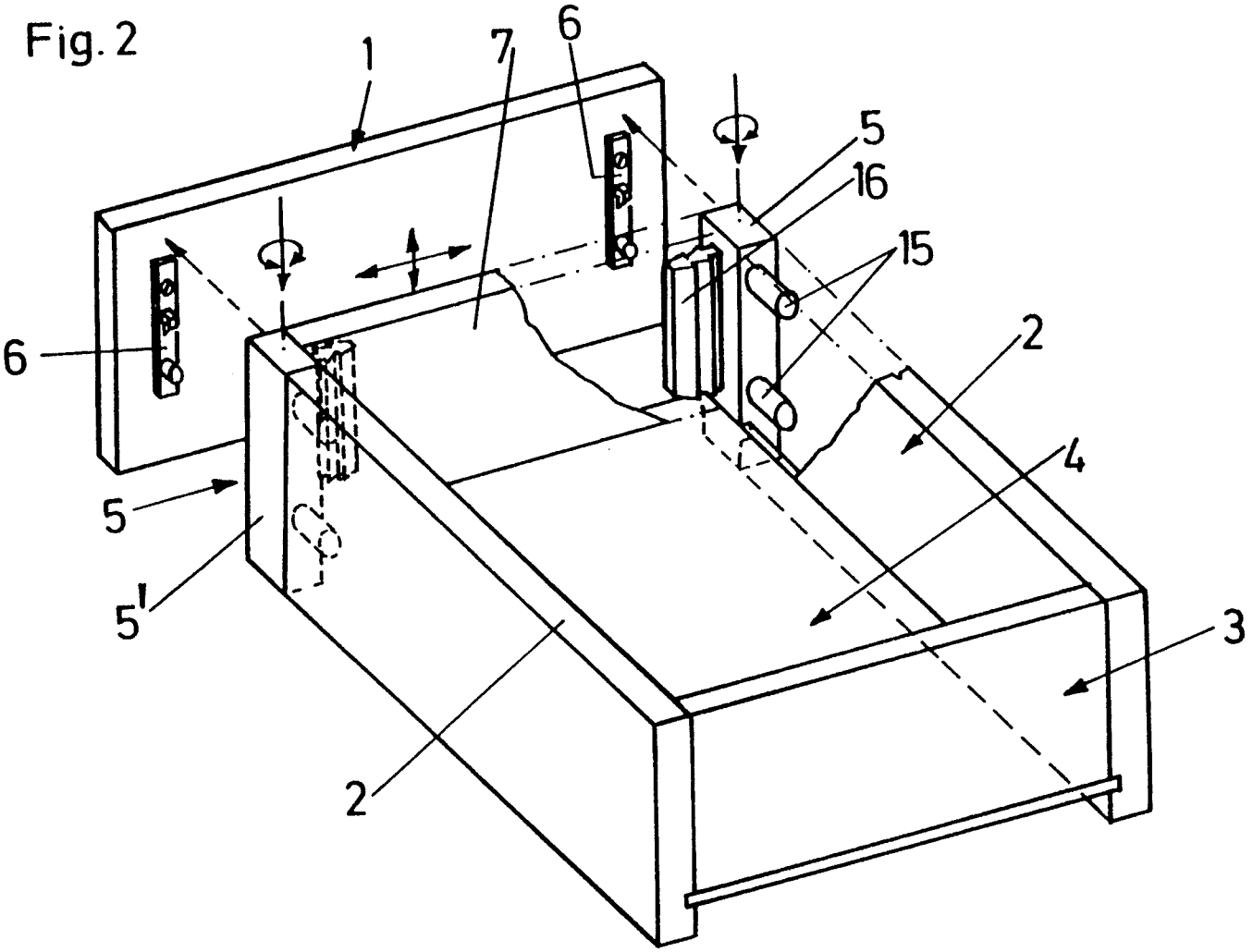

The securing apparatuses 5 are secured to the front ends of the drawer side walls 2 by means of dowels 15. Instead of the dowels 15, a dowel strip 16 equally could be provided, as shown in FIG. 2, as securing means for securing each apparatus 5 to front plate 7.

Figure 5:
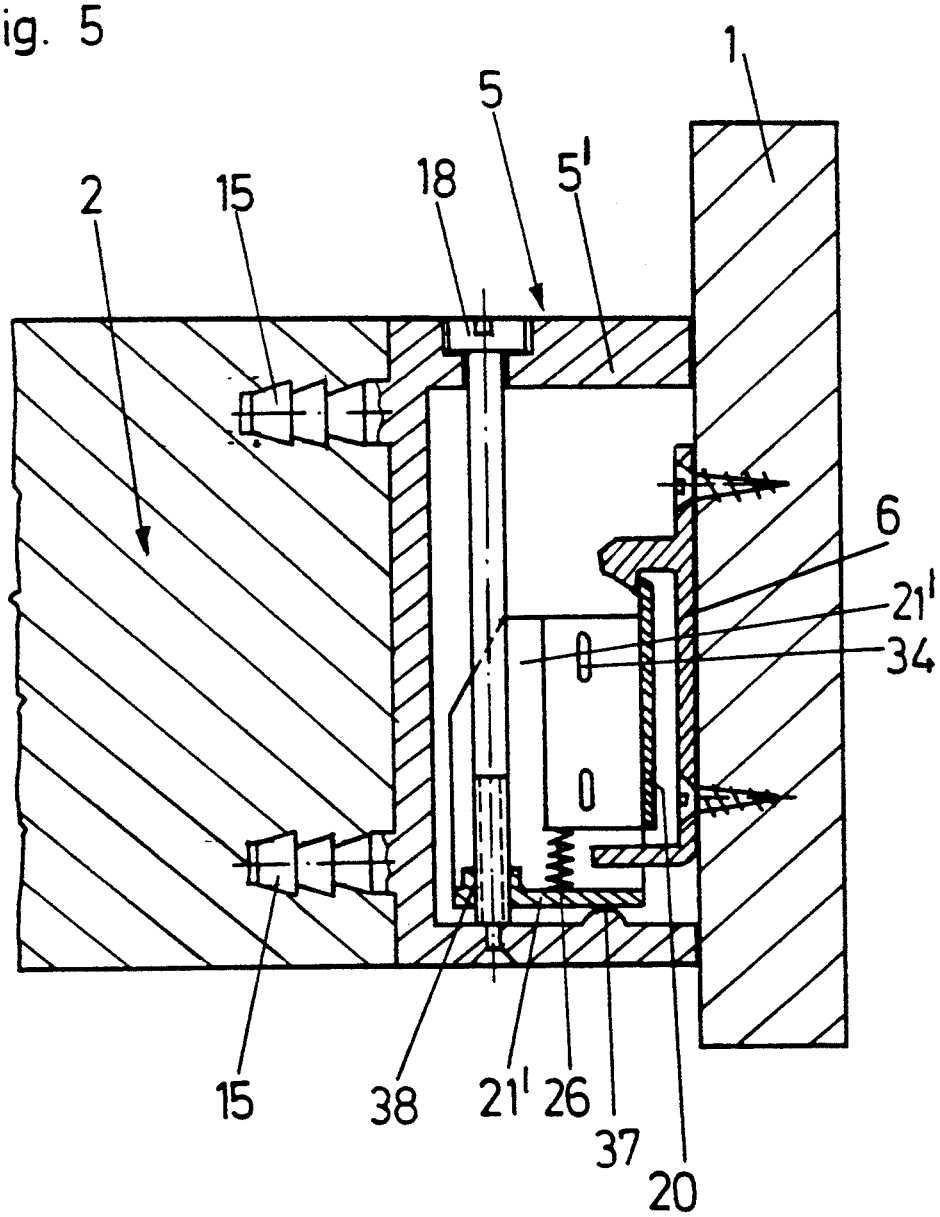
FIGS. 5 and 6 are vertical sections perpendicular to the drawer front panel through two different embodiments of a front panel securing apparatus according to the invention.
Figure 7:
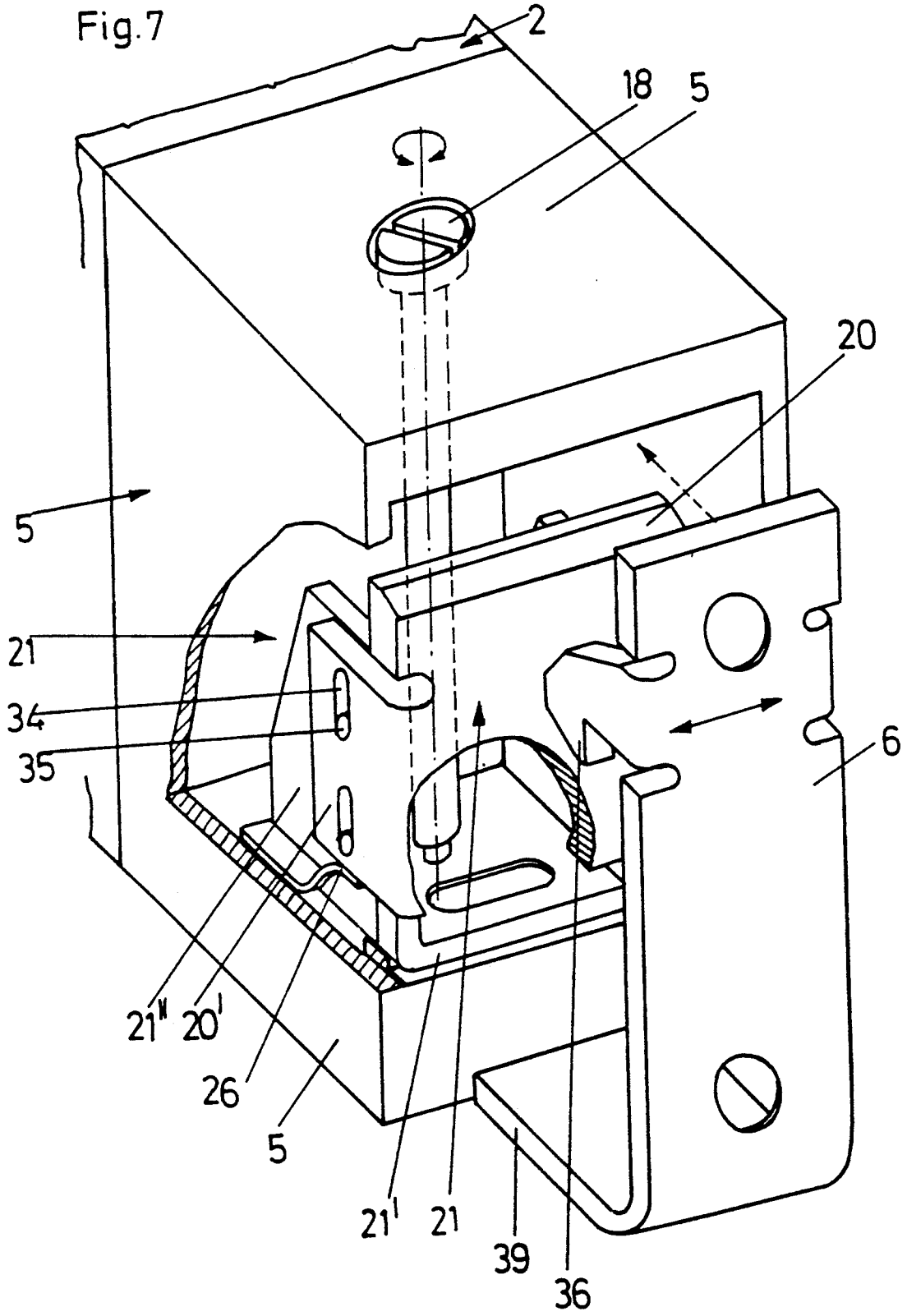
FIGS. 7 and 8 are perspective views, partially cut away, of such embodiments of a front panel securing apparatus according to the invention.

A simpler form of the front panel securing apparatus or means 5, which allows only adjustment of the front panel 1 to the side, is shown in FIGS. 5 and 7. Each securing apparatus 5 includes a housing 5' which is dowelled directly to the drawer side wall 2 and which extends the drawer side wall 2 virtually as far as the front panel 1 and thus preferably has the same height and width as the drawer side wall 2.

A carrier element 21 is mounted within the housing 5' The carrier element 21 is in two parts including a carrier body member 21' and a latch or insert member 20 on which holding member 6, secured to the front panel 1 by means of screws or the like, is directly suspendable.

As may be seen from FIGS. 5 and 7, the carrier body member 21' of the carrier element 21 is, as seen from the front, U-shaped with lateral flanges 21'', and the latch or insert member 20 is, as seen in plan view, U-shaped with lateral flanges 20'. The latch member 20 has lateral vertical slits 34 into which project guide pegs 35 which are secured to the side flanges 21'' of the carrier body member 21'. The latch member 20 surrounds, with its flanges 20', the carrier body member 21' of the carrier element 21 and its flange 21'' and is held in an upper position relative thereto by a spring 26. It is possible to press member 20 downwardly against the force of spring 26 over the length of slits 34. This makes possible suspension of the front panel 1 when the drawer is pushed into a furniture body, since the front panel 1 may be pushed, below an already mounted front panel 1 of a drawer located above or below a projecting edge of an upper base, into the front panel securing means 5 exactly at the height at which it is subsequently to be held. The length of the slits 34 must therefore be at least as long as the height of hooks 36 of the holding members 6.

Once the front panel 1 is in a suspended position with the holding members 6, a screw 18 is turned to fix or brace front panel 1. As can be seen in particular from FIG. 5, the carrier element 21 rests on a cam 37 in the housing 5' of the front plate securing apparatus 5. The screw 18 is threaded through a female thread 38 in a lower plate of the carrier element body 21'. The screw 18 is held axially undisplaceably in the housing 5' of the securing apparatus 5 and thus, when the screw 18 is turned the lower plate of carrier body member 21 is tilted about the cam 37. If the screw 18 is turned such that such lower plate is tilted rearwardly, that is to say away from the front panel 1, then the holding member 6 is braced by the front plate or web of the insert part of carrier element 21.

The holding members 6 furthermore each have a lower horizontally projecting stop flange 39 which projects between the two lateral flanges 21'' of the carrier body member 21' and which, when stop flang 39 bears against one of flanges 21'', forms a limiting stop for the possibility of lateral displacement of the front panel 1.

Figure 6:
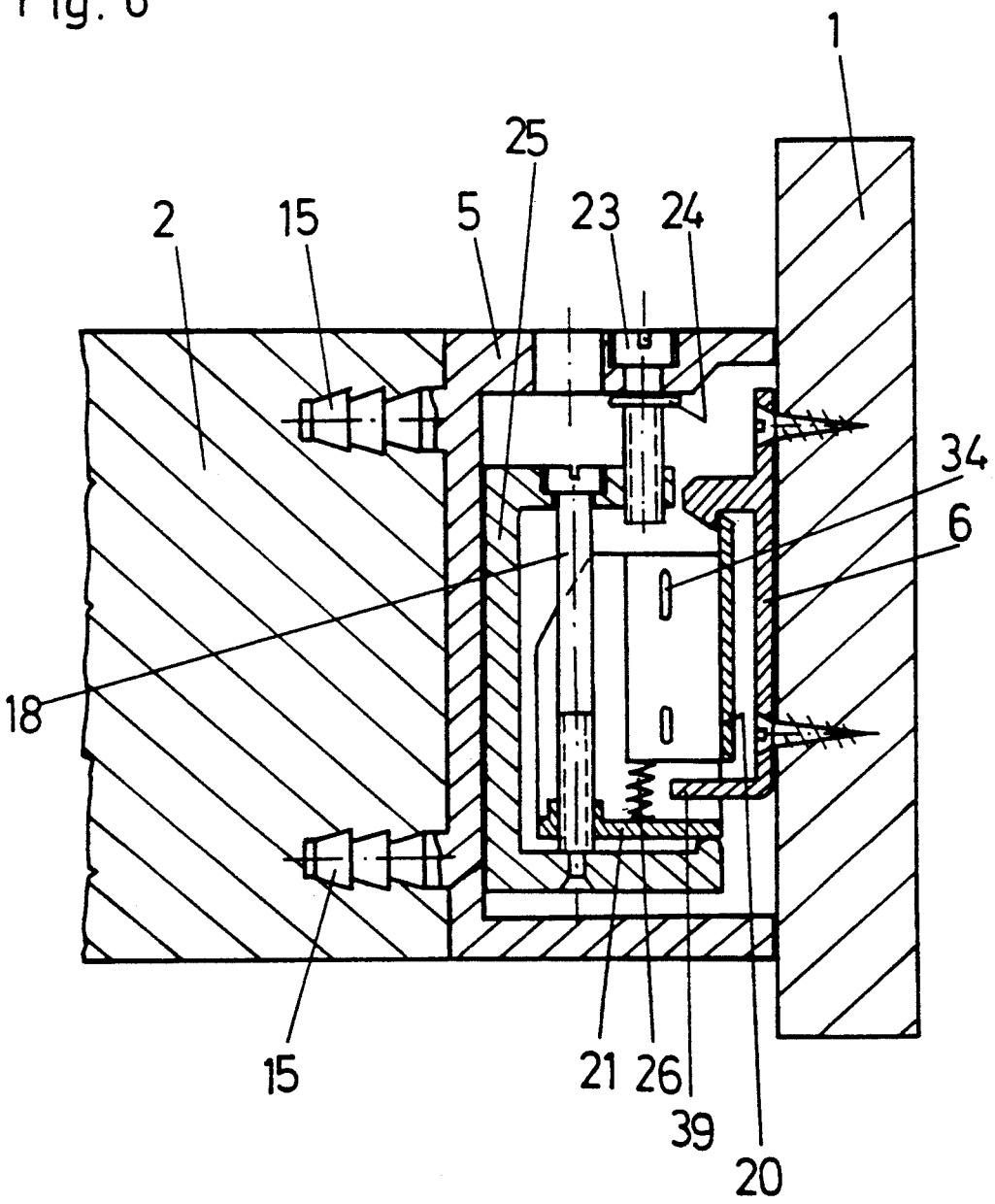
Figure 8:
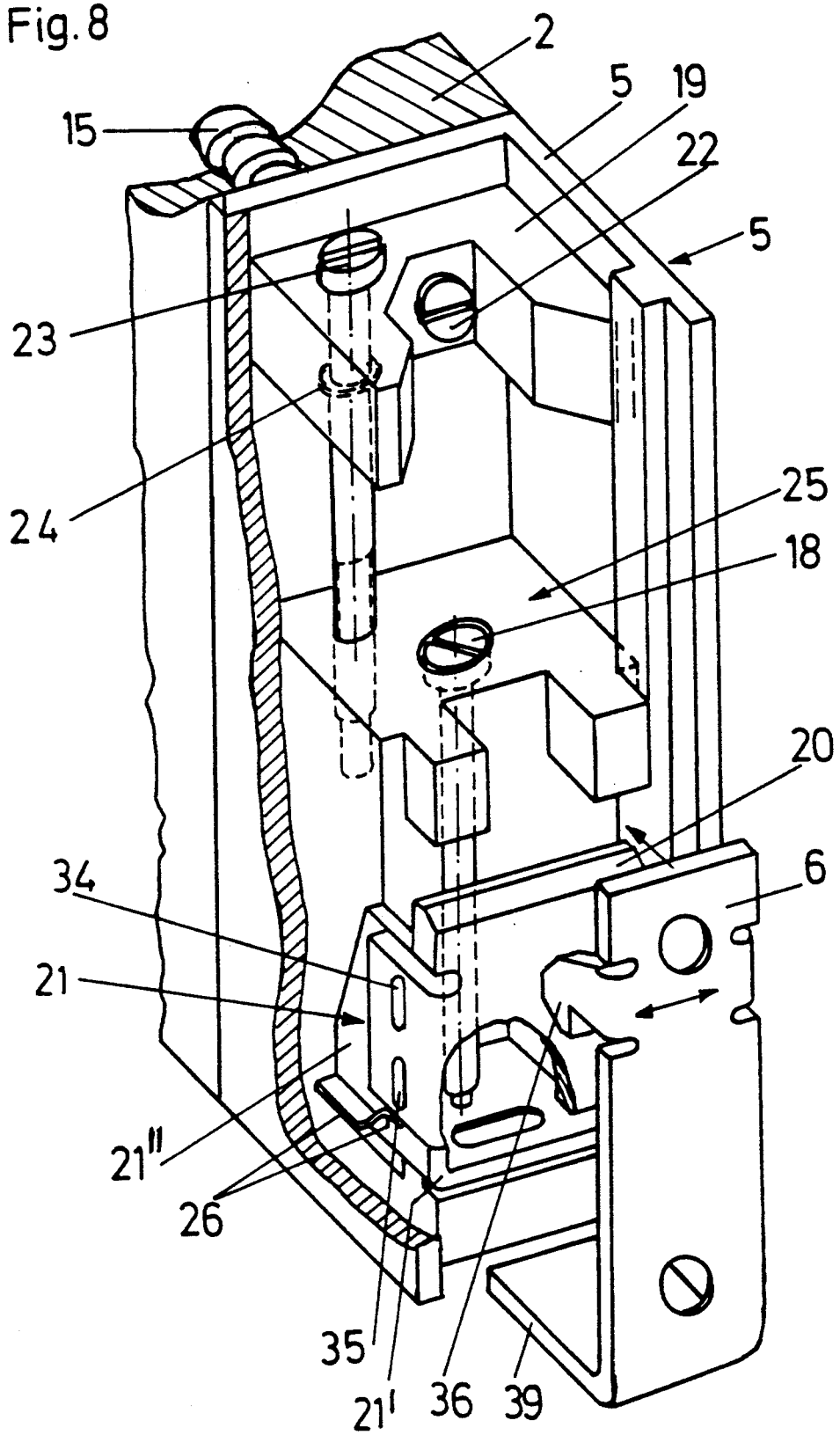

In the embodiment of FIGS. 6 and 8, there is arranged in housing 5' a vertically displaceable cage 25. In the case 25 is located the carrier element 21 including the carrier body member 21' and the latch member 20. The front panel 1 is mounted as in the previous embodiment by suspending the front panel 1 with the holding members 6 on the latch members 20 and by bracing the carrier element 21 by means of the screw 18.

By means of a screw 23, which is mounted in a frame 19 secured in the housing 5' by means of a screw 22 and which is threaded into a female thread in the cage 25, the cage 25 may be moved upwardly or downwardly. Thus, the height of the front panel 1 may be adjusted. The screw 23 has a projecting flange 24 which may be formed from a Seeger ring or the like and which secures the screw 23 in the housing 5'.

Figure 3:
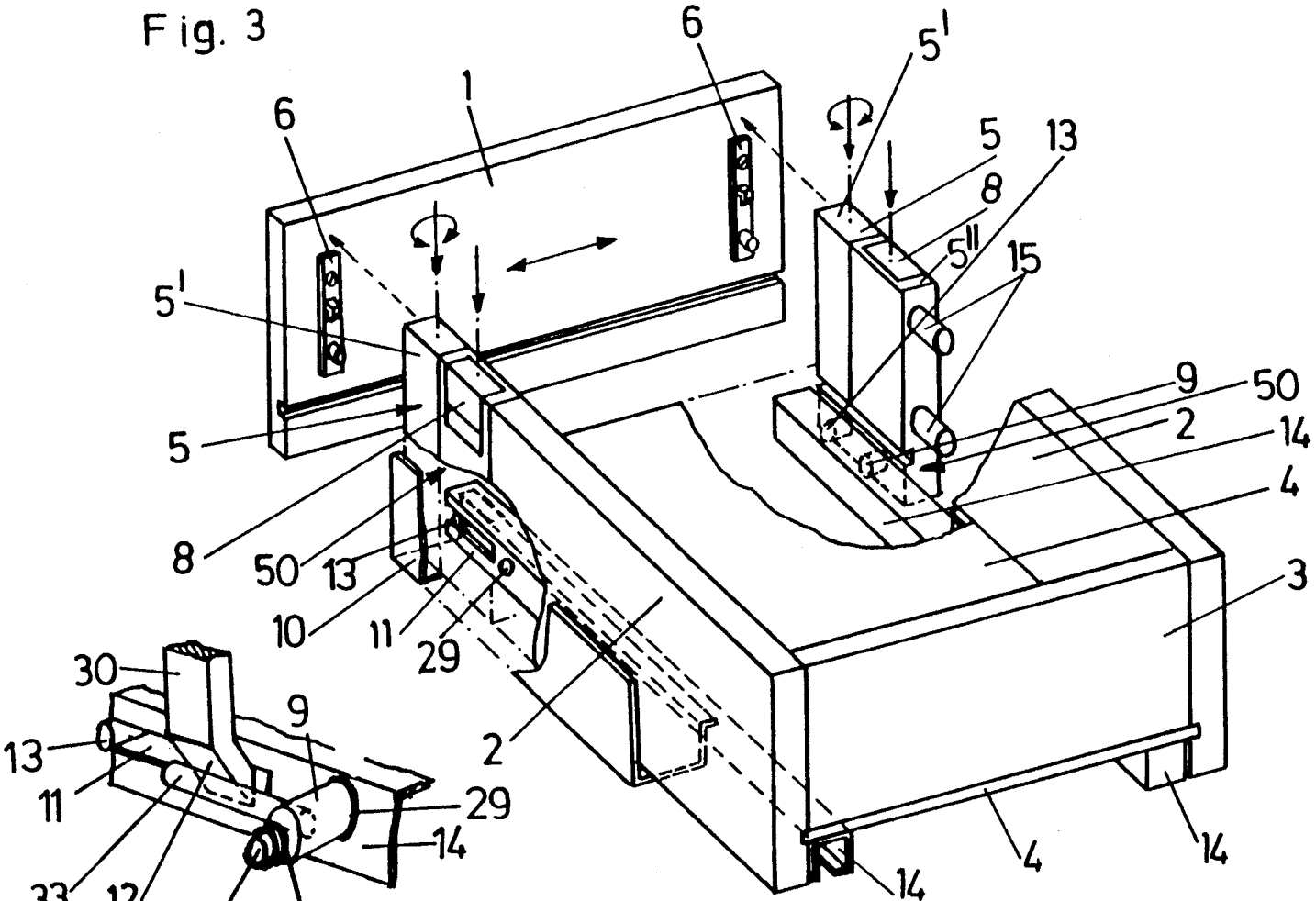
FIG. 3 is a perspective view showing a drawer having a front plate securing apparatus according to the invention and a removable holding apparatus for a pull-out rail.
Figure 3A:
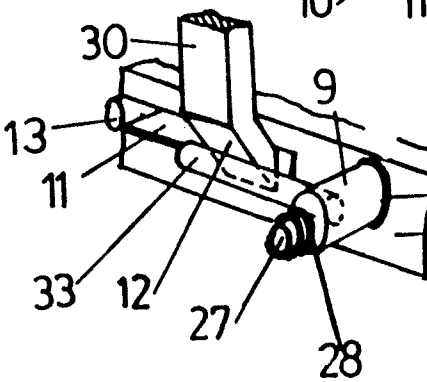
FIG. 3A is an enlarged detail view thereof.

As can be seen from FIGS. 3 and 3A, it is possible for a removable holding apparatus 50 for a pull-out rail 14 of the drawer to be provided directly behind the securing apparatus 5, preferably in a housing part 5'' associated therewith.

Figure 4:
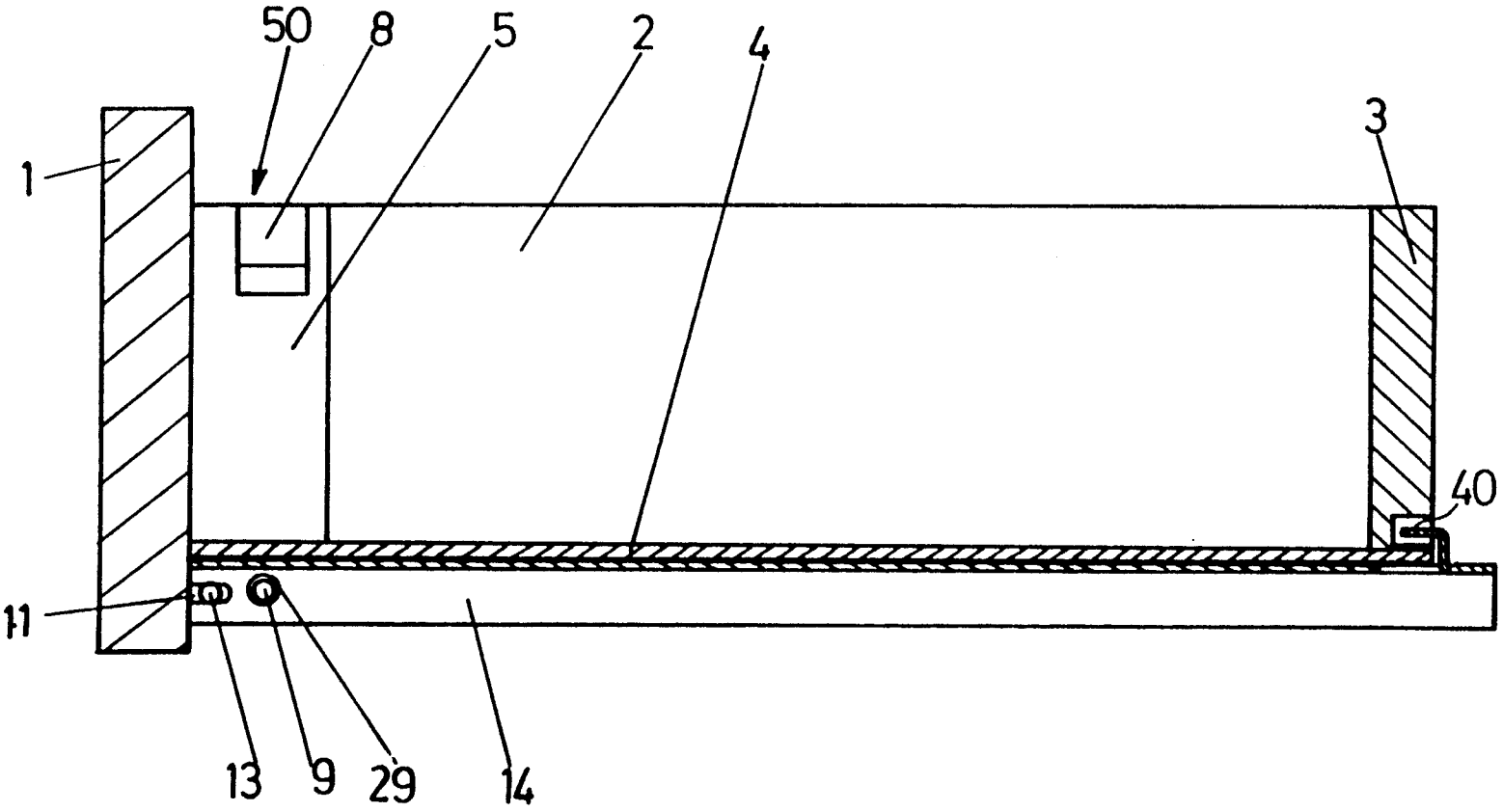
FIG. 4 is a side view in section of a drawer having a removable holding apparatus for a rail.

The pull-out rail 14 is provided at the rear thereof with a hook 40 by means of which it can be anchored in the drawer rear wall 3 (see FIG. 4). At the front, the pull-out rail 14 has a slit 11 open to the front and through which projects a locking peg 13 extending laterally from the drawer or from the holding apparatus 50.

In order to remove the drawer from rail 14, rail 14 must be moved rearwardly relative to the drawer to the anchoring therebetween (pin 13, hole for hook 40). Such movement is hindered by a locking peg 9 which in the normal condition projects through a corresponding hole 29 in the rail 14 and which is displaceable in the holding apparatus 50 horizontally in a plane parallel to the front panel 1.

The locking peg 9 is mounted on a carrier peg 27 and is pressed by a helical spring 28 into hole 29 in a vertical web 14' of the draw-out rail 14. The locking peg 9 has a stop 33 which is formed, for example by a laterally projecting cylindrical edge. Bearing against stop 33 by means of a wedge surface 12 is an unlocking rod 30 arranged vertically in the housing 5''. The unlocking rod 30 is mounted at its upper end in a pushbutton-type part 8 and is held in its upper position by a helical spring 32. In this upper position of the unlocking rod 30, the draw-out rail 14 is locked to the drawer.

Figure 9:
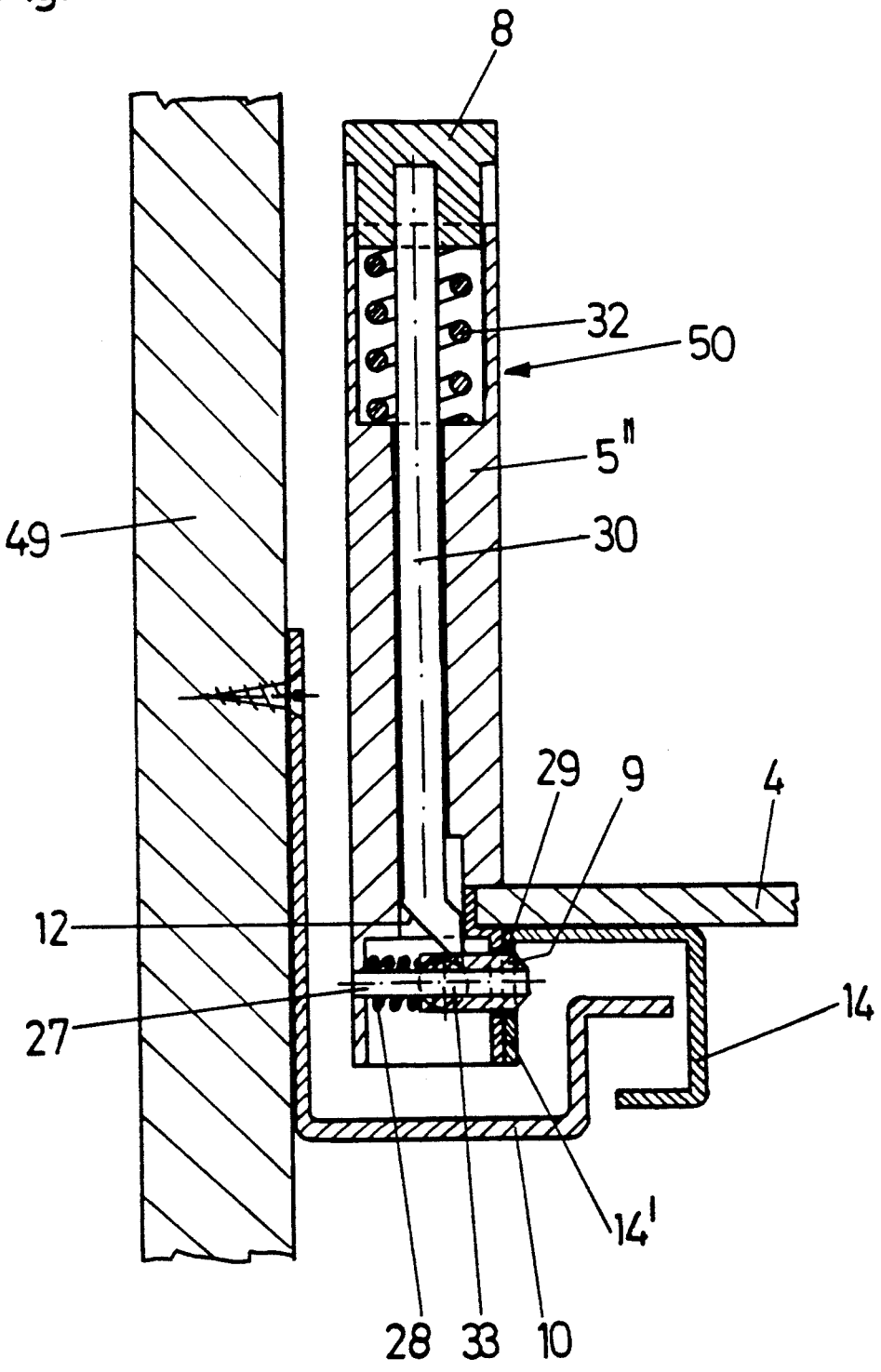
FIG. 9 is a vertical section parallel to the drawer front panel through a removable holding apparatus for the pull-out rail.

If pressure on the button-shaped part 8 then moves the unlocking rod 30 downwardly, then the wedge surface 12 of the unlocking rod 30 presses the locking peg 9 laterally outwardly via the stop 33, i.e. toward a side wall 49 of the furniture body and thus out of the hole 29 in rail 14. It now is possible for the rail 14 to be withdrawn freely rearwardly out of its anchoring with the drawer. In FIGS. 3 and 9, a supporting rail 10 is shown mounted on furniture body side wall 49.

We claim:

1. An apparatus for securing a front panel of a drawer to a respective side wall of the drawer, said apparatus comprising:

a housing having an interior space, said housing to be mounted on the drawer side wall;

a carrier member mounted on said housing, said carrier member having a U-shaped configuration including a carrier member web to be horizontal when said housing is mounted on the drawer side wall, said carrier member web having opposite ends, and spaced side flanges extending from respective said ends of said carrier member web;

a latch member supported by said carrier member for displacement relative to said carrier member, said latch member having a U-shaped configuration including a latch member web to be vertical when said housing is mounted on the drawer side wall, said latch member web having opposite ends, and spaced side flanges extending from respective said ends of said latch member web;

a holding member to be mounted on the front panel and to engage with said latch member when the front panel is mounted on the drawer side wall;

spring means acting on said latch member urging said latch member to be displaced relative to said carrier member to a position whereat said latch member is in engagement with said holding member; and a bracing member engaging said carrier member, for tilting said carrier member about an axis extending parallel to said carrier member web such that the engagement between said holding member and said latch member is braced.

2. An apparatus as claimed in claim 1, wherein said carrier member is mounted within said interior space of said housing.

3. An apparatus as claimed in claim 1, wherein said bracing member comprises a screw threadably engaging said carrier member and mounted dot an element to be rotatable relative to said element and axially fixed relative to said element, such that rotation of said screw about a longitudinal center line thereof will move said carrier member parallel to said center line relative to said element.

4. An apparatus as claimed in claim 3, wherein said screw threadably engages said web carrier member, and said screw extends perpendicularly to said carrier member web.

5. An apparatus as claimed in claim 3, wherein said element comprises said housing.

6. An apparatus as claimed in claim 3, wherein said element comprises a cage member mounted within said interior space of said housing for movement relative to said housing.

7. An apparatus as claimed in claim 6, wherein said carrier member is mounted don said cage member, and further comprising an adjustment screw threadably engaging said cage member and rotatably mounted on said housing for moving said cage member relative to said housing.

8. An apparatus as claimed in claim 1, wherein said holding member has a hook portion to engage with said latch member.

9. An apparatus as claimed in claim 8, wherein said hook portion engages said latch member web of said latch member.

10. An apparatus as claimed in claim 1, wherein said axis extend parallel to said carrier web.

11. An apparatus as claimed in claim 10, wherein said axis is defined by a cam surface projecting upwardly from a base of said housing, and said carrier member rests on said cam surface.

12. An apparatus as claimed in claim 1, wherein said spaced side flanges of said carrier member extend parallel to said latch member web, and said holding member has a flange projecting between said carrier member flanges.

13. An apparatus as claimed in claim 1, wherein said side flanges of said carrier member extend perpendicular to said carrier member web, and said side flanges of said latch member extend perpendicular to said latch member web.

14. An apparatus as claimed in claim 1, wherein one of said carrier member and said latch member have holes formed therein, and the other of said latch member and said carrier member have guide pins projecting therefrom into said holes.

15. An apparatus as claimed in claim 14, wherein said holes are elongated.

16. An apparatus as claimed in claim 15, wherein said holes are elongated parallel to said latch member web.

17. An apparatus as claimed in claim 16, wherein said holes are formed in said side flanges of said one of said members, and said guide pins extend from said side flanges of said other of said members.

18. An apparatus as claimed in claim 17, wherein said side flanges of said latch member are overlap said side flanges of said carrier member.

19. An apparatus as claimed in claim 1, wherein said housing is constructed to be mounted on a front end of the drawer side wall.

20. An apparatus as claimed in claim 1, wherein said housing has means for anchoring said housing to a drawer front plate.

* * * * *